US010787882B2

(12) United States Patent
Olsen et al.

(10) Patent No.: US 10,787,882 B2
(45) Date of Patent: Sep. 29, 2020

(54) ADAPTIVE PRESSURE RELIEF VALVE SET POINT SYSTEMS

(71) Applicant: Halliburton Energy Services, Inc., Houston, TX (US)

(72) Inventors: Karl Kristian Olsen, Sandnes (NO); Torgrim Haaland, Sandnes (NO)

(73) Assignee: Halliburton Energy Services, Inc., Houston, TX (US)

( * ) Notice: Subject to any disclaimer, the term of this patent is extended or adjusted under 35 U.S.C. 154(b) by 553 days.

(21) Appl. No.: 15/536,117

(22) PCT Filed: Jan. 23, 2015

(86) PCT No.: PCT/US2015/012584
§ 371 (c)(1),
(2) Date: Jun. 14, 2017

(87) PCT Pub. No.: WO2016/118150
PCT Pub. Date: Jul. 28, 2016

(65) Prior Publication Data

US 2017/0335654 A1 Nov. 23, 2017

(51) Int. Cl.

| | |
|---|---|
| ***G01V 1/40*** | (2006.01) |
| ***E21B 34/02*** | (2006.01) |
| ***E21B 21/08*** | (2006.01) |
| ***E21B 33/13*** | (2006.01) |
| ***E21B 41/00*** | (2006.01) |
| ***E21B 44/00*** | (2006.01) |

(Continued)

(52) U.S. Cl.
CPC ..... *E21B 34/02* (2013.01); *E21B 21/08* (2013.01); *E21B 33/13* (2013.01); *E21B 41/0092* (2013.01); *E21B 44/00* (2013.01); *E21B 47/06* (2013.01); *E21B 33/06* (2013.01)

(58) Field of Classification Search
None
See application file for complete search history.

(56) References Cited

U.S. PATENT DOCUMENTS

| | | | | |
|---|---|---|---|---|
| 9,664,003 | B2 * | 5/2017 | Nott | E21B 21/106 |
| 10,000,981 | B2 * | 6/2018 | Nott | E21B 21/08 |
| 2003/0196804 | A1 | 10/2003 | Riet | |

(Continued)

OTHER PUBLICATIONS

International Search Report and Written Opinion for PCT/US2015/012584 dated Sep. 22, 2015.

*Primary Examiner* — Aditya S Bhat
(74) *Attorney, Agent, or Firm* — Gilliam IP PLLC

(57) ABSTRACT

Systems and methods are described for controlling pressure relief valve (PRV) set points in real-time during various well and drilling operations. An example method may include receiving, by one or more processors, one or more input variables associated with one or more characteristics of a well during a first time period. The method may include calculating a first PRV set point based at least partially on a model of the well utilizing the one or more input variables received during the first time period. The method may include determining whether the first PRV set point is valid based at least partially on a predetermined expected range of PRV set points for the well. Additionally, the method may include transmitting the first PRV set point to a PRV controller when the first PRV set point is determined to be valid.

20 Claims, 6 Drawing Sheets

(51) Int. Cl.
*E21B 47/06* (2012.01)
*E21B 33/06* (2006.01)

(56) References Cited

U.S. PATENT DOCUMENTS

| | | | | |
|---|---|---|---|---|
| 2006/0207795 | A1 | 9/2006 | Kinder et al. | |
| 2010/0288507 | A1 | 11/2010 | Duhe et al. | |
| 2012/0227961 | A1 | 9/2012 | Sehsah | |
| 2013/0299240 | A1 | 11/2013 | Leuchtenberg | |
| 2016/0097270 | A1* | 4/2016 | Pobedinski | E21B 21/08 700/275 |

* cited by examiner

ADAPTIVE PRESSURE RELIEF VALVE SET POINT SYSTEMS

BACKGROUND

Various well systems may control borehole pressure of a well. In a conventional open well system, piping/riser for returning drilling fluid is typically open to atmospheric pressure. Closed-loop well systems include surface equipment to which the returning drilling fluid can be diverted. Certain managed pressure drilling (MPD) systems may be characterized as closed and pressurized drilling fluid systems. MPD and like systems provide various techniques for regulating borehole pressure, however, existing pressure regulation techniques are often inadequate for certain types of wells and reservoir formations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
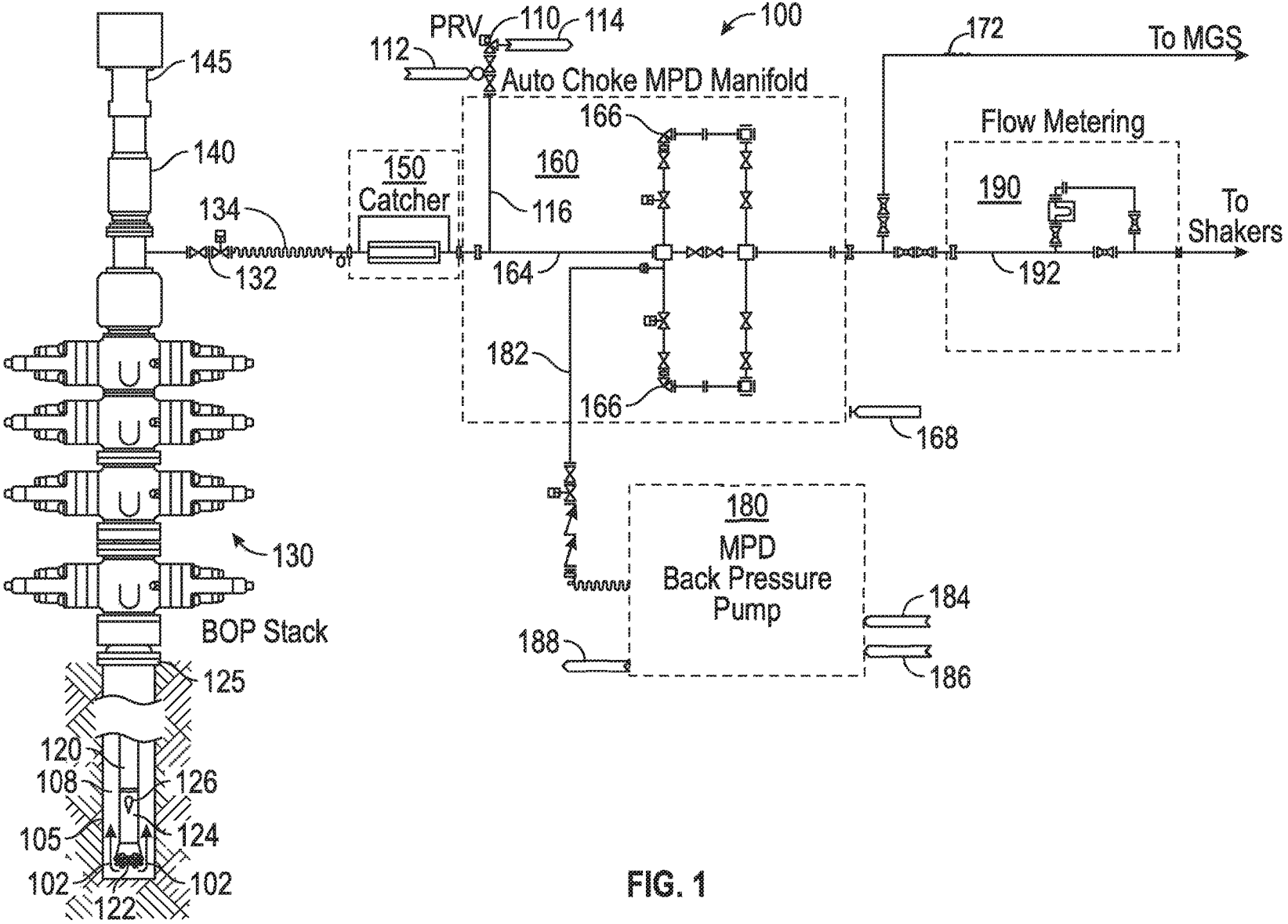
FIG. 1 is a diagram of an example well system that may employ various principles of the present disclosure.

The present disclosure generally relates to well drilling, and more particularly, to controlling borehole pressure of a well during various well drilling operations.

Systems and methods are described herein to control pressure relief valve (PRV) set points in real-time during various well and drilling operations. PRV set points may be provided to a PRV controller at certain time intervals during various well and drilling operations such that a series of consecutive PRV set point values account for changes to the pressure profile of the borehole (or wellbore) during such operations.

According to embodiments described herein, a dynamic PRV set point system is utilized to enable precise borehole pressure management of wells that have narrow pore pressure, fracture pressure windows, for example. Drilling fluid (e.g., mud) may be circulated down a drill string and up the annulus of the well to create an equivalent circulating density (ECD). During normal drilling operations, the ECD should be greater than the pore pressure of the borehole, but below the pressure that would initiate fracture of the subterranean formation being penetrated. By calculating and providing PRV set points in real-time during various well and drilling operations, non-productive time and costs to remedy issues resulting from improper pressure levels within the borehole (e.g., a stuck pipe of the drill string or damage to the reservoir formation) may be mitigated or avoided altogether.

For example, if there is not enough pressure in the borehole, the wall of the borehole may collapse and/or subsurface fluids (e.g., water or gas) may blow through the drilling fluid annulus return. If there is too much pressure in the borehole, the drilling fluid pressure may fracture the subterranean formation. Thus, it can be advantageous in certain wells to keep the pressure in the borehole within a pressure range above pore pressure and below fracture initiation pressure (e.g., drilling margin or pore-pressure-fracture-gradient window).

Benefits of a dynamic PRV set point system may be realized in various well operations, for example, cementing operations where ECD and hydrostatic pressure of a cement composition (e.g., a mixture of cement and water, and possibly additives) or cement slurry may require precise control for proper setting while cementing a casing in the subterranean formation and to protect the subterranean formation from fracturation.

It is to be further understood that when drilling mature fields, the potential hazard that a reservoir may collapse is exacerbated. Thus, if excess pressure is permitted to build within the borehole and exceeds the fracture gradient, access to some or all of the hydrocarbons in the subterranean formation may be unattainable.

As shown in the examples provided herein, dynamically calculating and providing PRV set points to a pressure relief valve can enable precise control of borehole pressure such that pressure is maintained within the pore-pressure-fracture-gradient window even during changing pressure conditions associated with certain well and drilling operations. In this regard, PRV set points are calculated in real-time and provided to a PRV controller, in accordance with aspects of the present disclosure.

FIG. 1 illustrates an example well system 100. A well as used herein with respect to well system 100 can be, but is not limited to, an oil and gas well. In some implementations, well system 100 may include a drilling rig, semi-submersible platform, or fixed platforms, for example. Well system 100 may comprise PRV assembly 110, wellhead 125, blowout preventer (BOP) stack 130, choke manifold 160, and flow meter assembly 190. Well system 100 may also comprise additional components illustrated in FIG. 1, as well as additional components not expressly identified.

In certain embodiments, well system 100 may comprise drill string 120 that is configured to pass through wellhead 125 to drill borehole 105. Drill string 120 may include a drill bit 122 configured to rotate and pass drilling fluid 102 (e.g., mud) therethrough. In this regard, drilling fluid 102 may be circulated through drill string 120, out of drill bit 122, and upward through annulus 108 formed at least partially between an outer surface of drill string 120 and the wall of the borehole 105. Drilling fluid 102 may be circulated for the purpose of cooling drill bit 122, lubricating drill string 120, and removing cuttings from borehole 105, for example. Drilling string 120 may include one or more sensors 124 to provide bottom hole measurements and one-way flow valve 126 (or similar non-return or check valve). The one or more sensors 124 may include, for example, a pressure while drilling (PWD) sensor, measurement while drilling (MWD) sensor, and/or logging while drilling (LWD) sensor.

Well system 100 may be adapted to provide cementing operations, in accordance with certain implementations. For example, upon removing the drill string 124, a cementing operation may be required to secure one or more lengths of casing from wellhead 125. The casing is cemented into the borehole 105 by pumping cement through the casing and back up the annulus defined between the exterior off the casing and the wall of the borehole 105. In this regard, the BOP stack 130 may be used to inject a cement mixture into at least a portion of the annulus. Similarly, liner running operations may be required for extending support of the borehole 105 beyond the casing string. Cementing and liner running operations can benefit from controlling borehole pressure during such respective operations as described herein.

BOP stack 130 may be coupled to wellhead 125, and may include one or more valves to prevent the escape of fluid pressure in the borehole 105. One or more pressure sensors may be disposed in wellhead 125 to sense pressure in the wellhead 125 below the BOP stack 130, for example. Well system 100 may further comprise a rotating control device (RCD) 140 disposed above the BOP stack 130. RCD 140 can seal a top portion of the drill string 120 above wellhead 125 thereby enabling control of the borehole 105 pressure by sealing the annulus 108 such that the annulus 108 is isolated from the atmosphere.

Still referring to FIG. 1, drill string 120 may extend upwardly through RCD 140 and be operatively coupled to one or more components of rotary table and standpipe assembly 145. While not shown, rotary table and standpipe assembly 145 may include a rotary table, top drive or swivel, standpipe, standpipe line, Kelly, one or more pumps (i.e., drilling fluid or cement pumps, depending on the application), and/or other top-side drilling equipment. Cement pumps may be used during cementing operations and configured to inject a cement mixture to the borehole 105 for cementing a casing therein.

In some embodiments, rotary table and standpipe assembly 145 may include a continuous circulation device. The continuous circulation device may be operatively coupled to the rotary table and configured to provide continuous drilling fluid 102 circulation by allowing one or more drilling fluid pumps (not shown) to stay active when a new drill pipe segment is being connected to drill string 120. In this regard, the continuous circulation device can be configured to maintain constant downhole pressure during connections (e.g., connection mode). For example, the continuous circulation device may include a sealable internal chamber into which drilling fluid 102 may be pumped from one or more ports. The internal chamber may be configured to enclose a section of the drill string 120 between a junction of a topmost drill pipe and a top drive. As such, continuous drilling fluid 102 circulation is possible by pressurizing the internal chamber with drilling fluid 102 via the one or more ports and then separating the top drive from the topmost drill pipe. Thus, drilling fluid 102 may flow into an open end of the topmost drill pipe via the pressurized chamber of the continuous circulation device.

A bottom area of the pressurized chamber can be isolated (e.g., activating blind rams to bisect the internal chamber above the open end of the topmost drill pipe) so that drilling fluid 102 can be continuously injected into the open end of the topmost drill pipe while the top drive is removed from a top area of the internal chamber of the continuous circulation device (e.g., after drilling fluid 102 flow from a standpipe manifold has been stopped). A new section of drill pipe can be connected to the top drive and guided into the continuous circulation device whereby an open end of the new section of drill pipe can be sealingly introduced into the internal chamber when the top area is once again in fluid communication with the pressurized bottom area of the internal chamber (e.g., after release of the blind rams within the internal chamber). Drilling fluid 102 may then be injected into the open end of the topmost drill pipe with the internal chamber via the one or ports of the continuous circulation device and the standpipe via the open end of the new section of drill pipe connected to the top drive. The open end of the topmost drill pipe and the open end of the new section of drill pipe may be guided to establish contact. The new section of drill pipe can then be rotated to sealingly connect the drill pipe segments together. After connection, delivery of drilling fluid 102 via the one or more ports of the continuous circulation device can cease and the internal chamber may be depressurized. Delivery of drilling fluid 102 for circulation through drill string 120 and into the borehole 105 can now be provided solely by the top drive and standpipe connected to the new section of drill pipe (now the topmost drill pipe of the drill string 120).

In operation, returning drilling fluid 102 may exit the wellhead 125 via one or more valves 132 disposed at a top of the BOP stack 130 below RCD 140, for example. The one or more valves 132 can be in fluid communication with annulus 108 and return flowline 134. The return flowline 134 may be coupled to a catcher 150 (e.g., junk catcher) to remove various objects from the returning drilling fluid 102. For example, catcher 150 may be configured to catch and redirect objects from the returning drilling fluid 102 that have accidentally been injected into or left inside a drill pipe of drill string 120 prior to being put down hole, such as but not limited to gloves, tape, tools, safety glasses, pieces of rubber sealing elements, etc. A flow meter or sensor may be positioned along return flowline 134 proximal to catcher 150. Catcher 150 may be fluidly coupled to choke manifold 160 via return flowline 164, for example. Choke manifold 160 includes one or more chokes 166 (e.g., in a redundant formation). One or more flow meters or sensors may be arranged throughout various sections and flowlines of the choke manifold 160.

PRV assembly 110 may include one or more pressure relief valves or similar devices for controlling flow. For example, two pressure relief valves may be used in some implementations so that if a first pressure relief valve malfunctions (e.g., fails to reseat), a second pressure relief valve can be switched into operation. PRV assembly 110 may also include one or more sensors or flow meters, a flush point 112, and a discharge port 114. In operation, the one or more pressure relive valves of PRV assembly 110 can discharge drilling fluid 102 to provide pressure relief in excess of a maximum allowable pressure of the well system 100 during sudden changes in pressure of the borehole 105 caused by unexpected, abnormal conditions of the subterraneous formation, for example.

Choke manifold 160 may be fluidly coupled to PRV assembly 110 via return flowline 116, which is fluid communication with return flowline 164. Backpressure may be applied to the annulus 108 by variably restricting flow of the returning drilling fluid 102 via operation of the one or more chokes 166. Choke manifold 160 may include an air pressure port 168 for operating the one or more chokes 166. Further backpressure may be applied by backpressure pump 180, in accordance with certain embodiments.

Backpressure pump 180 may be fluidly coupled to choke manifold 160 via flowline 182, and may include a charge pump port 184, cooling water port 186, and a water discharge port 188, for example. Similarly, one or more flow meters or sensors may be arranged throughout various sections of backpressure pump 180 including flowline 182. In this regard, back pressure pump 180 can provide pressure into the return flowlines so that the one or more chokes 166 can remain open during drill pipe connections (e.g., connection mode). Having the one or more chokes 166 open and operable during such time enables the choke manifold 160 to respond changes in borehole pressure during such drill pipe connections and other well drilling operations, for example.

In some embodiments, a pump diverter (e.g., rig pump diverter) may be used alternatively or in addition to backpressure pump 180. For example, the pump diverter may include a manifold with a choke for diverting the flow of drilling fluid 102 from the one or more drilling fluid pumps to provide continuous fluid flow to the choke manifold 160 during drill pipe connections, for example. In this regard, flow of the drilling fluid 102 may be diverted from the standpipe to the choke manifold 160, thereby applying backpressure to the annulus 108 during various non-drilling well operations to maintain borehole pressure, in accordance with some embodiments. Whether backpressure pump 180 or a pump diverter is utilized in particular embodiments, the dynamic pressure applied by either to the choke manifold 160 can be advantageous over a static choke implementation when drilling operations ramp down or stop, for example.

Choke manifold 160 may be fluidly coupled to flow meter assembly 190 via return flowline 192. Flow meter assembly 190 may include one or more flow meters or sensor for measuring the returning drilling fluid 102, for example. Flow meter assembly 190 may be fluidly coupled to shaker return flowline 198, which conveys the drilling fluid to solids control units that remove debris from the drilling fluid. Choke manifold 160 may also be fluidly coupled to drilling fluid-gas separator return flowline 172. A drilling fluid-gas separator (e.g., a mud gas separator or MGS) may be configured to capture and separate a volume of free gas within the drilling fluid 102.

It is understood that other variations and alternatives are contemplated in addition to well system 100 illustrated in FIG. 1 and described herein, and therefore any particular example aspect of well system 100 in no way should be read to limit, or define, the scope of the disclosure.

Figure 2:
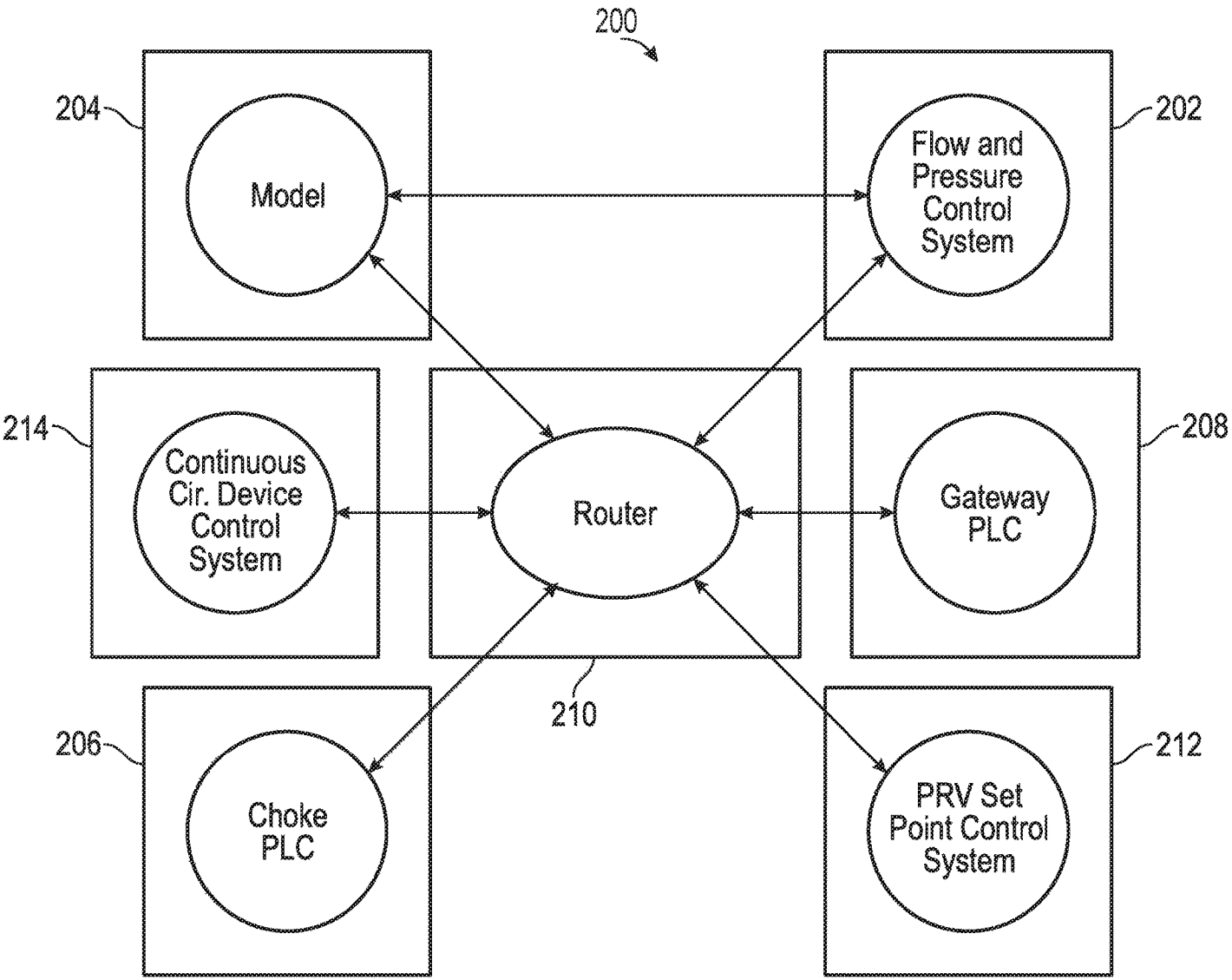
FIG. 2 is a diagram of an example system and network environment that may employ various principles of the present disclosure.

FIG. 2 illustrates an example system 200 and network environment that may be used in conjunction with a well, such as but not limited to well system 100 of FIG. 1. System 200 may include one or more of a flow and pressure control system 202 (e.g., an MPD control system), a model 204 (e.g., a hydraulic model), a choke interface 206 (e.g., choke programmable logic controller), a gateway interface 208 (e.g., gateway programmable logic controller), a PRV set point control system 212, and/or a continuous circulation device control system 214. System 200 may also include a router 210 configured to enable data to be routed between one or more networks, systems, and devices. For example, PRV set point control system 212 may be operatively coupled to model 204 via router 210 as illustrated in FIG. 2. However, in other embodiments, PRV set point control system 212 may include model 204 as a software module or application. Similarly, other systems and/or software modules in system 200 may be combined or aggregated in various embodiments (e.g., PRV set point control system 212 and/or continuous circulation device control system 214 may be subsystems or software modules, applications, or the like of flow and pressure control system 202).

Flow and pressure control system 202 may comprise various processes for controlling flow and pressure associated with drilling operations (e.g., MPD drilling) of well system 100. In this regard, flow and pressure control system 202 may be operably coupled to various flow meters and/or sensors to receive data therefrom. Flow and pressure control system 202 may be operably coupled to choke interface 206 and gateway interface 208 for activating and controlling various devices and components of well system 100. For example, choke interface 206 may be operatively coupled to choke manifold 160 and/or other components such as backpressure pump 180. Gateway interface 208 may be operatively coupled to various valves and switches for controlling the various well and drilling components, as well as to various real-time sensors, meters, gauges, etc., for transmitting and receiving data to and from the drilling control network.

Accordingly, flow and pressure control system 202 may cause the one or more chokes 166 to increase or decrease flow resistance. Additionally, flow and pressure control system 202 may be operable to control one or more components of rotary table and standpipe assembly 145 to redirect drilling fluid 102 (e.g., temporarily suspending circulation of drilling fluid 102 in some embodiments or redirecting drilling fluid 102 to maintain circulation in other embodiments). Thus, flow and pressure control system 202 can be configured to control pressure of borehole 105 of well system 100.

Model 204 can be a subsystem or software module of flow and pressure control system 202 or may be a standalone system. In some embodiments, model 204 may be a subsystem or software module of PRV set point control system 212. Accordingly, model 204 may be of various complexities and comprises various input variables and parameters depending on a particular implementation (e.g., modelling well characteristics from a few pressure and flow input variables, or a comprehensive hydraulic model based on numerous input variables and historical data).

Model 204 may be used to determine the desired annulus pressure at or near wellhead 125 to achieve a desired borehole pressure. Data such as but not limited to well geometry, fluid properties, well information or characteristics (e.g., geothermal gradient and pore pressure gradient, etc.) may be utilized by model 204 in conjunction with real-time sensor, meter, and/or gauge data acquired by gateway interface 208 and/or other devices and interfaces to determine the desired instantaneous annulus pressure.

It is to be understood that certain well characteristics and data that are utilized in model 204 may include relatively static values or parameters (e.g., generally static information about the well that may not change such as, but not limited to, well size). Other well characteristics and data may include dynamic values or parameters (e.g., real-time hole depth measurements). For example, in some implementations, the subterranean formation of the well may be a mature field, and therefore model 204 may include information regarding various known characteristics about a particular reservoir or reservoirs. For example, the ideal pressure at various depths of the subterranean formation may be known or calculated based on information and data from model 204.

PRV set point control system 212 may be operatively coupled to and configured to control PRV assembly 110 of FIG. 1. For example, PRV assembly 110 may include a controller (e.g. an auxiliary programmable logic controller, remote input/output device, programmed computer, etc.) operatively coupled to the PRV set point control system 212 such that dynamic PRV set points may be provided in real-time to one or more pressure relief valves of the PRV assembly 110. PRV set point control system 212 may access model 204 for determining the dynamic set points.

In this regard, PRV set point control system 212 may utilize model 204 and certain real-time sensor, meter, and/or gauge data acquired by gateway interface 208 and/or other devices and interfaces to determine a desired instantaneous set point for PRV assembly 110. Similarly, PRV set point control system 212 may use model 204 and certain real-time sensor, meter, and/or gauge data to predict one or more future desired set points (e.g., a series of desired set points based on detected steady-state and/or changing conditions).

It is to be understood that, in accordance with aspects of the subject technology, determining dynamic set points is accomplished by PRV set point control system 212 in an automated process or processes. However, PRV set point control system 212 may be configured for user entry and input such that certain information and control may be afforded a user during the determination of the dynamic PRV set points and/or transmission to the PRV assembly 110, for example.

Continuous circulation device control system 214 may be operatively coupled to and configured to control a continuous circulation device of rotary table and standpipe assembly 145, for example, when a particular implementation of well system 100 includes such continuous circulation functionality. Continuous circulation device control system 214 can communicate with flow and pressure control system 202 so that drilling fluid 102 may be appropriately diverted and/or redirected during stages of the drill pipe connection process.

System 200 and network environment may also include other controllable electronic devices (e.g., gauges, flow meters, sensors, alarms, etc.) communicably connected to one or more computers or servers (e.g., flow and pressure control system 202, PRV set point control system 212, and/or continuous circulation device control system 214), such as by router 210 or other networking techniques. It is understood that in certain embodiments, each of flow and pressure control system 202, PRV set point control system 212, and continuous circulation device control system 214 may be a single computing device such as a computer server. In other embodiments, flow and pressure control system 202, PRV set point control system 212, and continuous circulation device control system 214 may represent more than one computing device working together to perform the actions of a server computer (e.g., a distributed system or sharing of certain data). Moreover, in some embodiments, each of flow and pressure control system 202, PRV set point control system 212, and continuous circulation device control system 214 may be operatively coupled with various databases or other computing devices that may be collocated with the well system 100, or that may be disparately located.

PRV set point control system 212, for example, may include one or more processing devices and one or more data storage devices. One or more processing devices may execute instructions stored in one or more data storage devices, which may store the computer instructions on non-transitory computer-readable medium.

Figure 3:
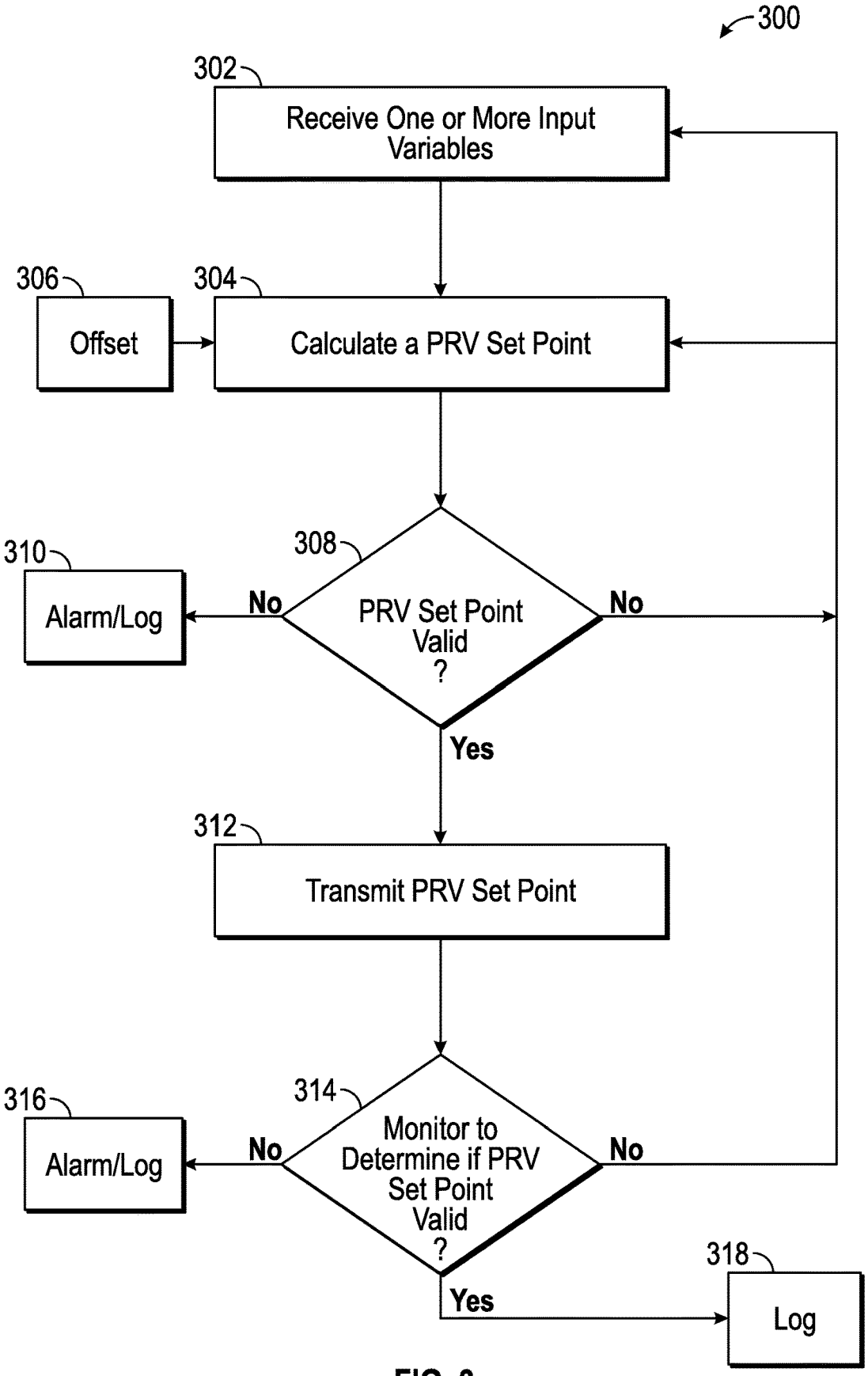
FIG. 3 is flow diagram of an example method for calculating and providing dynamic pressure relief valve (PRV) set points in accordance with aspects of the present disclosure.

FIG. 3 is flow diagram of an example method 300 for calculating and providing dynamic PRV set points. It is to be understood that the operations in method 300 may be used in conjunction with other methods/processes and aspects of the present disclosure described herein. Although certain aspects of method 300 are described with relation to the example embodiments provided in FIGS. 1 and 2, method 300 is not limited to such.

Method 300 may be used in conjunction with well system 100 and system 200 and network environment to control borehole (or bottom hole or wellbore) pressure during various well and drilling operations. In block 302, PRV set point control system 212 may receive one or more input variables associated with one or more characteristics of well system 100. The one or more input variables may be received or acquired during a time period, for example, 500 milliseconds, one second, 30 seconds, etc. The time period may change during the course of method 300 depending on the particular well or drilling operation, or stage thereof. Moreover, it is to be understood that certain input variables may be acquired at different time intervals or frequencies than other input variables, and such data acquisition time intervals may be different from the time period associated with receiving the one or more variables.

The one or more input variables and/or parameters) may include data from rig, platform, or other top-side equipment and/or bottom hole assembly (BHA) data. For example, the one or more input variables may include, but are not limited to, 'bit depth', 'hole depth', 'stand pipe pressure', 'hookload', 'rotary speed', 'rotary torque', 'wellhead pressure', 'flow in', 'density in', 'temperature in', 'flow backpressure', 'BHA temperature,' BHA pressure,' and 'BHA equivalent circulating density (ECD)'.

In accordance with certain aspects, 'bit depth' may be determined at a particular instance in time. For example, during the certain instances of drilling operation, the 'bit depth' and the 'hole depth' input variables may simultaneously increase and be the same. However, 'bit depth' may change as the drill bit 122 is retracted from the borehole 105 during some drilling operations, for example. 'Bit depth' and 'hole depth' input variables may be values in feet or meters.

'Stand pipe pressure' may be measured and/or calculated in bars, PSI, or pascals. 'Hookload' may be measured and/or calculated in tons. 'Rotary speed' input variable relates to the rotary speed of drill string 120 and may be a value in revolutions per minute (RPM) or radians per second. 'Rotary torque' input value relates to the rotary torque of drill string 120, and may be expressed in newton meters or foot pounds. 'Wellhead pressure' input variable relates to the actual pressure value of wellhead 125, for example, as measured at choke manifold 160, and may be expressed in bars, PSI, or pascals.

In certain aspects, 'flow in' input variable relates to a rate of flow of drilling fluid 102 into the borehole 105 from drilling fluid pumps, and can be measured by or derived from the drilling fluid pumps or a separate sensor or flow meter, for example. 'Flow in' input variable may be directly measured or calculated from other data, and may be expressed in liters per minute. 'Density in' input variable relates to a density of the drilling fluid 102 flowing into the borehole 105 from the rig or platform, and can be similarly measured by or derived from the drilling fluid pumps or a separate sensor or flow meter. Density of the drilling fluid 102 can be measured in kilograms per liter, for example. 'Temperature in' input variable relates to an instantaneous temperature of the drilling fluid 102 flowing into the borehole 105 from the rig or platform, and can be similarly measured by or derived from the drilling fluid pumps or a separate sensor or flow meter.

It is to be understood that, in some aspects, 'flow in', 'density in', and 'temperature in' input variables may relate to fluids other than drilling fluid 102. For example, 'flow in', 'density in', and 'temperature in' input variables may relate to a cement composition that can be supplied by one or more cement pumps on the rig or platform.

In certain aspects, 'flow backpressure' input variable relates to the flow pressure added to the annulus 108 of borehole 105 by backpressure pump 180, for example. In certain embodiments, backpressure pump 180 may provide a flow of drilling fluid 102 adequate such that the one or more chokes 166 can be maintained within an operable range during connection mode. As noted herein, in some embodiments, a pump diverter may be used to eliminate the need for backpressure pump 180. Thus, in some aspects, 'flow backpressure' input variable can relate to the flow pressure added to the annulus 108 of borehole 105 by a pump diverter.

Additional non-limiting examples of input variables include 'BHA temperature,' BHA pressure,' and 'BHA ECD.' For example, BHA temperature, pressure, and ECD can be acquired by and/or determined from measuring devices in the bottom hole assembly such as but not limited to one or more sensors 124 of drill string 120.

In block 304, PRV set point control system 212 may calculate a PRV set point. The PRV set point may be calculated based at least partially on model 204 and may utilize the one or more input variables. In this regard, model 204 of a well in well system 100 may utilize one or more of the various input variables and additional information (e.g., results from geological samples and data loggers) associated with the rig or platform equipment and subterranean formation, for example. Thus, model 204 can provide an instantaneous pressure profile of the well. For example, a range of pressure values including a high limit (e.g., fracture gradient) and low limit that the well can handle may be developed from model 204. When 'hole depth' or 'stand pipe pressure' input variables change, for example, a resulting pressure profile of model 204 may likewise change.

Accordingly, model 204, from which the pressure profile of the well and PRV set points may be calculated, is continuously changing throughout various well and drilling operations. For example, clay, sandstone, limestone formations encountered during the drilling process may substantially alter model 204 of the well. Thus, in certain aspects, PRV set point control system 212 is configured to dynamically calculate a plurality of PRV set points as the drill extends or retracts meter by meter within the reservoir and second by second based on the information in model 204 and the received one or more input variables.

For example, model 204 may utilize the following equation to calculate an instantaneous borehole or bottom hole pressure: BHP (bottom hole pressure)=hydrostatic pressure (e.g., drilling fluid weight)+ frictional pressure (ECD)+ backpressure (e.g., applied by choke manifold). This BHP equation and the various components thereof may be solved using the one or more input variables as updated by real-time sensor, meter, and/or gauge data in accordance with aspects of the present disclosure.

In some implementations, for example, some of the general guidelines or ranges associated with a given subterranean formation may be known based on historical data of the various input variables or parameters of the well. Additionally, during certain drilling operations, PRV set point control system 212 is configured to detect a condition in which the pressure profile is expected to be generally stable. As such the time period or intervals at which the one or more input variables are received and/or the PRV set points are calculated may be increased (e.g., less frequent calculation of dynamic PRV set points). In this regard, a limited number of input variables and/or parameters may be required to calculate dynamic PRV set points within an estimated range, for example, thereby limiting the processing burden on one or more processors of PRV set point control system 212.

As shown in block 306, the calculation of the PRV set point may include adding an offset value to the computed value for the PRV set point. For example, PRV set point control system 212 may provide an offset as a parameter to be used in computing or calculating the PRV set point. In some aspects, the offset parameter may be provided by a well operator based on known characteristics of the rig or platform equipment and subterranean formation. The offset parameter may be a static value for a specific implementation and added to the PRV set point as initially computed by the PRV set point control system 212. In some embodiments, the offset parameter may be a variable and applied based on a determined mode of operation. For example, a first offset value may be used when the rig or platform is in drilling mode as determined by one or more input variables (e.g., based on a high threshold of rotary torque of the drill string 120), and a second offset value may be used when the rig or platform equipment is in connection mode as similarly determined by one or more input variables (e.g., based on a low threshold of rotary torque of the drill string 120).

In some embodiments, PRV set point control system 212 can distinguish between a drilling operation and a cementing operation based on at least partially the one or more input variables (e.g., based on 'density in'). However, in other embodiments, a user may enter a parameter indicating that a cementing operation is being initiated. Accordingly, PRV set point control system 212 can provide different offset values for various operations associated with the well.

In block 308, PRV set point control system 212 may determine whether the calculated PRV set point is valid. PRV set point control system 212 may base such a determination at least partially on a predetermined expected range of PRV set points for the well. For example, as noted herein, model 204 may include information regarding various known characteristics about a particular reservoir or reservoirs. As such, expected ranges of PRV set points for the well may be calculated by PRV set point control system 212.

In some embodiments, a user may enter parameters into PRV set point control system 212 indicating the expected range of PRV set points for the well. Thus, the predetermined expected range of PRV set points can be the user-entered PRV set points or the user-entered PRV set points modified or adjusted by one or more characteristics associated with model 204 (e.g., factoring a known narrow pore-pressure-fracture-gradient window of the well at a specific hole depth) in accordance with various embodiments. If the calculated PRV set point is determined to be invalid, PRV set point control system 212 may determine whether an input variable value of one of the received one or more input variables is out of variance with a predetermined range of acceptable input variable values. For example, one or more of the input variable may include a range of acceptable values based on actual historical data, expected rages for the specific well system configuration, and/or user-entered parameters.

When a received input variable value is determined to be out of variance, PRV set point control system 212 may then recalculate the PRV set point based at least partially on model 204 utilizing a default value for the input variable, for example. In some embodiments, the default value may be the last received valid value for that particular input variable and a recalculation performed to determine the PRV set point (e.g., return to block 304). In other embodiments, a new value for the out of range input variable value may be attempted to be acquired. For example, the presently received one or more input variables may be disregarded, and PRV set point control system 212 may receive a new one or more input variables associated with one or more characteristics of well system 100 (e.g., return to block 302).

If the calculated PRV set point is determined to be invalid, PRV set point control system 212 may generate an alarm (block 310). The alarm generated by the presumed invalid PRV set point may be logged so that the incident may be reviewed at a later time to determine the cause of the presumed miscalculation (e.g., faulty telemetry or malfunctioning components), for example.

As shown in block 312, if the calculated PRV set point is determined to be valid, PRV set point control system 212 may transmit the calculated PRV set point to a controller of PRV assembly 110, for example. In this regard, PRV set point control system 212 can control the operation of and change the mechanical settings of one or more pressure relief valves. Next, as shown in block 314, PRV set point control system 212 may monitor PRV assembly 110 to determine whether the calculated PRV set point is valid. For example, controller of PRV assembly 110 or other component can provide an indication to PRV set point control system 212 that at least one of the one or more of the pressure relief valves has tripped, activated, lifted or activated in some manner. When the calculated PRV set point is transmitted to the controller of PRV assembly 110 and at least one of the one or more of the pressure relief valves has been tripped, PRV set point control system 212 may generate a PRV trip alarm (block 316).

The PRV trip alarm generated by the presumed valid and calculated PRV set point may be logged along with other concurrent data points so that the PRV trip incident may be reviewed at a later time to determine the cause of the PRV trip incident (e.g., faulty telemetry, malfunctioning components, unexpected BHA temperature or pressure change, etc.). Additionally, in some embodiments, upon receiving a PRV trip alarm, PRV set point control system 212 may immediately recalculate or increase a frequency of calculating PRV set points (e.g., increase from a 10 second time interval to a 1 second time interval for calculating dynamic PRV set points).

Moreover, PRV set point control system 212 may log each of the calculated PRV set points that is transmitted to the controller of PRV assembly 110 (block 318), so that the PRV set points that did not result in a PRV trip incident can be later used for further analysis and historical data of the pressure profile of the well, for example.

Figure 4:
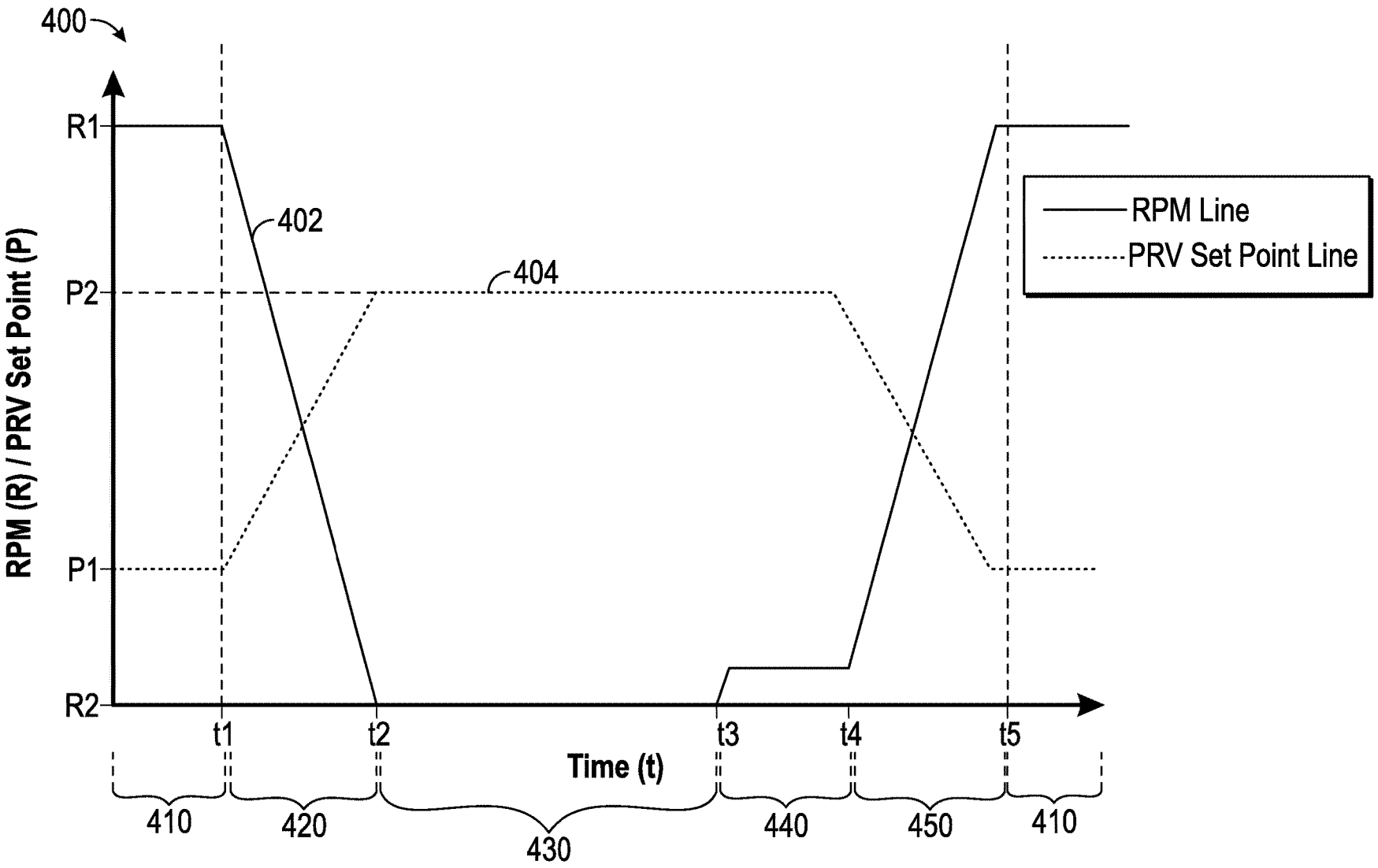
FIG. 4 is chart illustrating dynamic PRV set points plotted with respect to time during a first example of a drilling operation, in accordance with aspects of the present disclosure.
Figure 5:
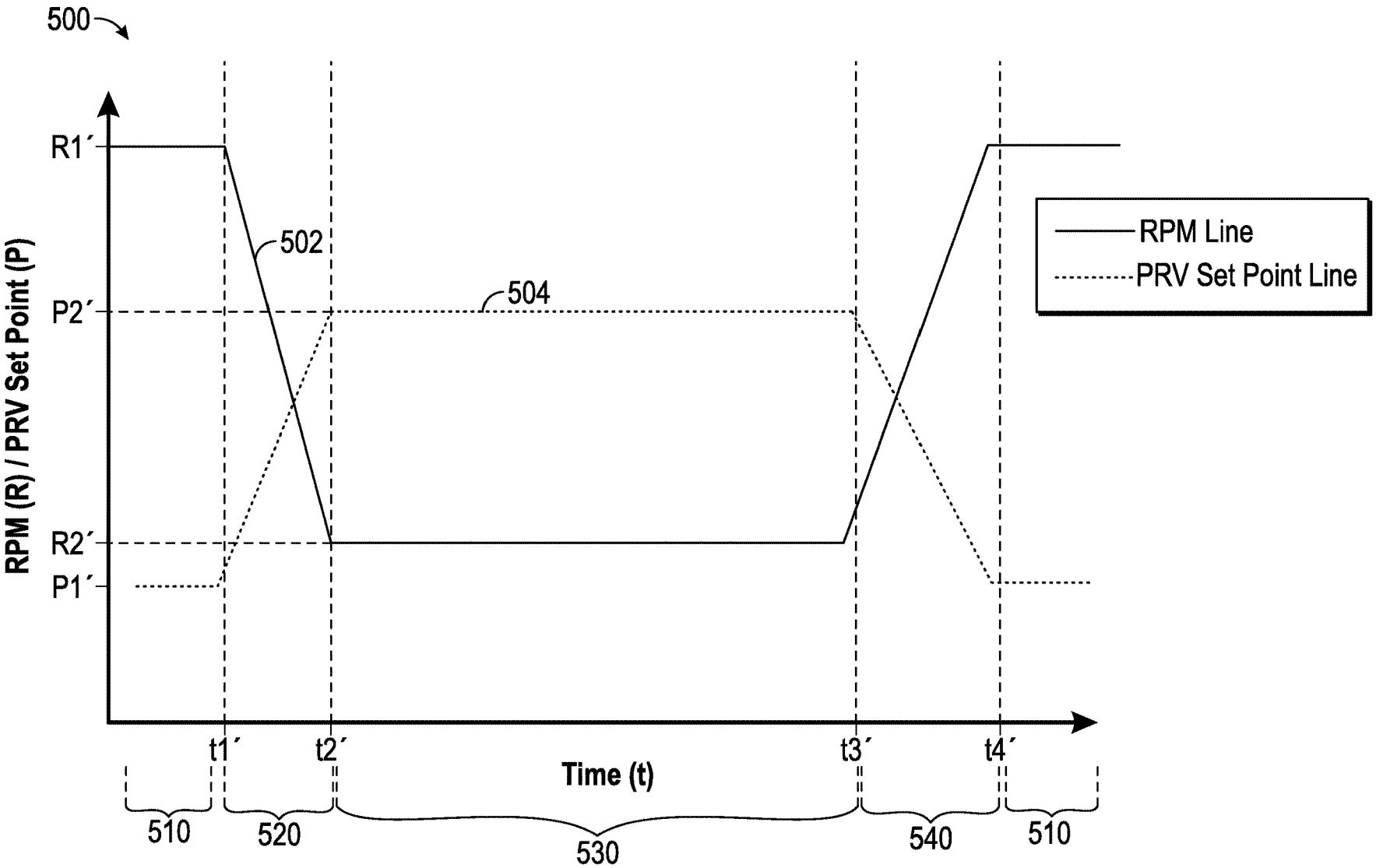
FIG. 5 is a chart illustrating dynamic PRV set points plotted with respect to time during a second example of a drilling operation, in accordance with aspects of the present disclosure.

Now referring to FIGS. 4 and 5, dynamic PRV set points are plotted with respect to time in accordance with various example drilling operations. FIGS. 4 and 5 illustrate exemplary calculations of PRV set points in accordance with the method 300 of FIG. 3 and other aspects of the present disclosure described herein. Accordingly, certain aspects of FIGS. 4 and 5 are described with relation to the example embodiments provided in FIGS. 1 and 2. However, aspects of the present disclosure described in FIGS. 4 and 5 are not limited to components and elements provided in the examples of FIGS. 1 and 2.

FIG. 4 provides a chart 400 that depicts dynamic PRV set points as plotted with respect to time. Chart 400 relates to an example of a drilling operation in which rotation of drill string 120 and a flow drilling fluid 102 through the borehole 105 is temporarily ceased when an additional drill pipe is added to drill string 120.

Example RPM line 402 and example PRV set point line 404 show changes in respective values of the lines during various drilling operations. RPM line 402 (i.e., pump RPM) refers to the rotary speed of a crankshaft or piston of the one or more pumps (i.e., drilling fluid or cement pumps, depending on the application). By using the rotary speed of the crankshaft and other pump data such as displacement (e.g., stroke and bore) with other data associated with the pump in use, a flow rate of the fluid injected into borehole 105 may be calculated. In this regard, RPM line 402 may be representative of the 'flow in' input variable and correlated thereto. PRV set point control system 212 can use the pump RPM to calculate the various dynamic PRV set points, for example. PRV set point line 404 may be representative of calculated PRV set points by PRV set point control system 212, in accordance with aspects of the present disclosure. As shown in chart 400, during drilling mode 410 from time 0 to time t1, pump RPM may be at a steady-state value R1, thereby resulting in generally steady-state calculated PRV set point value P1.

During pump ramp down mode 420 from time t1 to time t2, pump RPM may decrease in preparation for a drill pipe connection, in accordance with certain embodiments. As such, pump RPM may decrease from value R1 to a zero (or near zero) value R2. Likewise, PRV set point control system 212 may calculate a series of steadily increasing PRV set point values from value P1 to value P2. In certain examples, the rate of change between a series of consecutive PRV set points can be generally linear as illustrated in the example of FIG. 4. However, in other examples, the rate of change may be non-linear between a series of consecutive PRV set points.

In this regard, dynamically changing PRV set points during ramping down rotation of drill string 120 and/or stopping movement of the drill bit 122 longitudinally can provide precise pressure control in the borehole 105 during such transitional stages. In such instances, a higher pressure may be required in the borehole 105 to offset the frictional pressure caused by the drill bit 122 and/or the flow of drilling fluid 102 in order to support the subterranean formation. Accordingly, PRV set point control system 212 may calculate an associated higher PRV set point for the one or more pressure relief valves of the PRV assembly 110.

Additionally, PRV set point control system 212 may be configured to detect that drilling operations have transitioned from drilling mode 410 to pump ramp down mode 420. In this regard, PRV set point control system 212 can be configured to detect a condition reflecting a mode or stage for which frequent changing of PRV set points of the one or more pressure relief valves of PRV assembly 110 may aid in maintaining precise borehole pressure during certain changing conditions of well system 100. As such the time period or intervals at which the one or more input variables are received and/or the PRV set points are calculated may be decreased (e.g., more frequent calculation of dynamic PRV set points). For example, PRV set point control system 212 may be configured to detect a threshold change in an input variable where the threshold change is triggered based on a particular value of the input variable or a particular increase/decrease in value of the input variable over a specific period of time.

During connection mode 430 from time t2 to time t3, pump RPM may remain at zero (or near zero) value R2, thereby resulting in generally steady-state calculated PRV set point value P2. At this time, a new drill pipe may be added top-side to drill string 120 at top drive of rotary table and standpipe assembly 145, for example. During pump restart mode 440 from time t3 to time t4, drilling fluid pumps may begin activating and pump RPM may increase to a value slightly above R2 (but significantly below R1). The low RPM value at pump restart mode 440 enables urging of the drilling fluid (e.g., breaking gel strength) and helps to avoid pressure spikes upon restart. During pump restart mode 440, the corresponding calculated PRV set points may remain at approximately value P2.

Still referring to FIG. 4, during pump ramp up mode 450 from time t4 to time t5, pump RPM may increase as drilling operations move toward full speed with the new drill pipe connected to drill string 120, in accordance with certain embodiments. As such, pump RPM may increase from zero (or near zero) value R2 to value R1. Likewise, PRV set point control system 212 may calculate a series of steadily decreasing PRV set points from value P2 to value P1.

In some embodiments, PRV set point control system 212 may be configured to determine a PRV set point trend line (e.g., a portion of PRV set point line 404) based at least partially on two or more previously calculated PRV set points. Thus, PRV set point control system 212 may calculate one or more additional PRV set points based at least partially on the determined PRV set point trend line. For example, PRV set point control system 212 may extrapolate a series of PRV set points toward a previously known value at value P1, thereby limiting the processing burden on one or more processors and/or interface frequency requirement with other systems/devices of PRV set point control system 212. Similarly, a series of PRV set points may be extrapolated by PRV set point control system 212 when the PRV set point line 404 is generally flat (e.g., during drilling mode 410 and connection mode 430 scenarios). In certain embodiments and implementations, however, each calculated PRV set point may be based on real-time time sensor, meter, and/or gauge data.

At time t5, well system 100 may return to drilling mode 410. As such, pump RPM may return to steady-state value R1, thereby resulting in generally steady-state calculated PRV set point value P1. It is to be understood that chart 400 is merely exemplary and illustrating a relationship between the pump RPM and calculated PRV set point values. However, the calculated PRV set points may factor in numerous input variables, and therefore may or may not generally resemble example PRV set point line 404 in various embodiments and implementations.

FIG. 5 is a chart 500 illustrating dynamic PRV set points plotted with respect to time. Chart 500 relates to an example of a continuous circulation drilling operation. For example, well system 100 may include a continuous circulation device as a component of rotary table and standpipe assembly 145 in the continuous circulation drilling operation example illustrated in FIG. 5.

Example RPM line 502 and example PRV set point line 504 show changes in respective values of the lines during various drilling operations. RPM line 502 (i.e., pump RPM) refers to the rotary speed of a crankshaft or piston of the one or more pumps (i.e., drilling fluid or cement pumps, depending on the application). By using the rotary speed of the crankshaft and other pump data such as displacement (e.g., stroke and bore) with other data associated with the pump in use, a flow rate of the fluid injected into borehole 105 may be calculated. In this regard, RPM line 502 may be representative of the 'flow in' input variable and correlated thereto. PRV set point line 504 may be representative of calculated PRV set points by PRV set point control system 212, in accordance with aspects of the present disclosure. As shown in chart 500, during drilling mode 510 from time 0 to time t1', pump RPM may be at a steady-state value R1', thereby resulting in generally steady-state calculated PRV set point value P1'.

During pump ramp down mode 520 from time t1' to time t2', pump RPM may decrease in preparation for a drill pipe connection using a continuous circulation device, in accordance with certain embodiments. As such, pump RPM may decrease from value R1' to value R2', while drilling fluid 102 continues to circulate through borehole 105. Likewise, PRV set point control system 212 may calculate a series of steadily increasing PRV set point values from value P1' to value P2'. In certain examples, the rate of change between a series of consecutive PRV set points can be generally linear as illustrated in the example of FIG. 5. However, in other examples, the rate of change may be non-linear between a series of consecutive PRV set points. Moreover, as noted herein, PRV set point control system 212 may be configured to detect that drilling operations have transitioned from drilling mode 510 to pump ramp down mode 520 (or transitions from other modes or phases of operation).

During connection mode 530 from time t2' to time t3' in a continuous circulation drilling, pump RPM may remain at value R2', thereby resulting in generally steady-state calculated PRV set point value P2'. At this stage, a new drill pipe may be added top-side to drill string 120 at continuous circulation device and top drive of rotary table and standpipe assembly 145, for example. During pump ramp up mode 540 from time t3' to time t4', pump RPM may increase as drilling operations move toward full speed with the new drill pipe connected to drill string 120, in accordance with certain embodiments. As such, pump RPM may increase from value R2' to value R1'. Likewise, PRV set point control system 212 may calculate a series of steadily decreasing PRV set points from value P2' to value P1'.

At time t4', well system 100 may return to drilling mode 510. As such, pump RPM may return to steady-state value R1', thereby resulting in generally steady-state calculated PRV set point value P1'. It is to be understood that chart 500 is merely exemplary and illustrating a relationship between the pump RPM and calculated PRV set point values. However, the calculated PRV set points may factor in numerous input variables, and therefore may or may not generally resemble example PRV set point line 504 in various embodiments and implementations. Moreover, it is to be understood that FIGS. 4 and 5 are not drawn to scale, for example, a difference in the value between P1' and P2' of FIG. 5 may be substantially less than a difference in the value between P1 and P2 of FIG. 4

Figure 6:
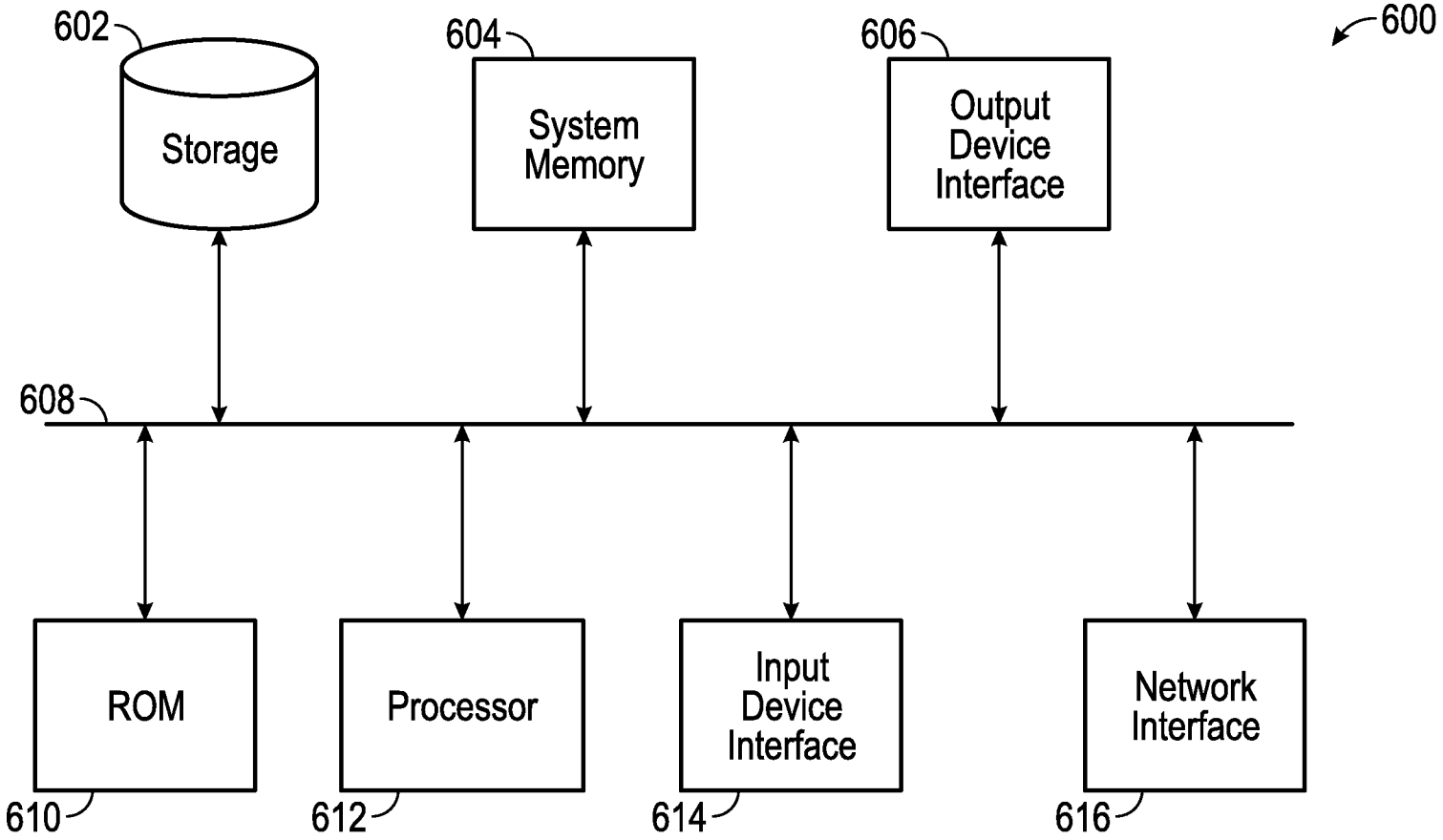
FIG. 6 conceptually illustrates a computer system with which certain aspects of the subject technology may be implemented.

FIG. 6 conceptually illustrates a block diagram of an exemplary computer system 600 with which one or more aspects of the subject technology may be implemented, for example, PRV set point control system 212 and/or flow and pressure control system 202. Computer system 600 can be a server and computer with one or more processors embedded therein or coupled thereto, or generally any computing device, and may include various types of computer readable media and interfaces for various other types of computer readable media. Computer system 600 may include, for example, a bus 608, processing unit(s) 612, a system memory 604, a read-only memory (ROM) 610, a permanent storage device 602, an input device interface 614, an output device interface 606, and a network interface 616.

Bus 608 collectively represents all system, peripheral, and chipset buses that communicatively connect the numerous internal devices of computer system 600. For instance, bus 608 may communicatively connect processing unit(s) 612 with ROM 610, system memory 604, and permanent storage device 602.

From these various memory units, processing unit(s) 612 may retrieve instructions to execute and data to process in order to execute the processes of the subject disclosure. The processing unit(s) can be a single processor or a multi-core processor in different implementations.

ROM 610 may store static data and instructions that are needed by processing unit(s) 612 and other modules of the computer system. Permanent storage device 602, for example, may include a read-and-write memory device. This device can be a non-volatile memory unit that stores instructions and data even when computer system 600 is off. Some implementations of the subject disclosure may use a mass-storage device (such as but not limited to a magnetic or optical disk and its corresponding disk drive) as permanent storage device 602.

Other implementations may use a removable storage device (such as but not limited to a floppy disk, flash drive, and its corresponding disk drive) as permanent storage device 602. Like permanent storage device 602, system memory 604 can be a read-and-write memory device. However, system memory 604 may be a volatile read-and-write memory, such a random access memory, in accordance with some implementations. System memory 604 may store some of the instructions and data that the processor(s) needs at runtime. In some implementations, the processes of the subject disclosure are stored in system memory 604, permanent storage device 602, or ROM 610. For example, the various memory units may include instructions for associated with controlling PRV set points in accordance with some implementations of the subject technology. From these various memory units, processing unit(s) 612 may retrieve instructions to execute and data to process in order to execute the processes of some implementations.

Bus 608 may also connect to input and output device interfaces 614, 606. Input device interface 614 enables a user to communicate information and select commands to the computer system. Input devices used with input device interface 614 include, for example, alphanumeric keyboards and pointing devices (also called "cursor control devices"). Output device interfaces 606 enables, for example, the display of images generated by the computer system 600. Output devices used with output device interface 606 may include, for example, printers and display devices, such as but not limited to cathode ray tubes (CRT) or liquid crystal displays (LCD). Some implementations may include devices such as a touchscreen that can function as both input and output devices.

As shown in FIG. 6, bus 608 may also couple computer system 600 to a network (not shown) through a network interface 616. In this manner, computer system 600 can be a part of a network of computers and/or various controllable electronic devices (e.g., the example system and network environment of FIG. 2). The network may include, for example, a local area network ("LAN"), a wide area network ("WAN"), or an Intranet, or a network of networks. Any or all components of computer system 600 can be used in conjunction with various aspects of the subject disclosure.

The functions described above can be implemented in digital electronic circuitry, in computer software, firmware or hardware. In this regard, computer system 600 may be used to implement various illustrative blocks, modules, elements, components, methods, and techniques described herein. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations may include electronic components, such as microprocessors, storage and memory that store computer program instructions in a machine-readable or computer-readable medium (alternatively referred to as computer-readable storage media, machine-readable media, or machine-readable storage media). Some examples of such computer-readable media may include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic or solid state hard drives, ultra density optical discs, any other optical or magnetic media, and floppy disks. The computer-readable media can store a computer program that is executable by at least one processors of processing unit(s) 612 and includes sets of instructions for performing various operations. Examples of computer programs or computer code include machine code, such as is produced by a compiler, and files including higher-level code that are executed by a computer, an electronic component, or a microprocessor using an interpreter.

For example, the instructions for performing various operations may be stored in the memory units and implemented in one or more computer program products, for example, one or more modules of computer program instructions encoded on a computer readable medium for execution by, or to control the operation of, the computer system 600, and according to any method known to those of skill in the art, including, but not limited to, computer languages such as data-oriented languages (e.g., SQL, dBase), system languages (e.g., C, Objective-C, C++, Assembly), architectural languages (e.g., Java, .NET), and application languages (e.g., PHP, Ruby, Perl, Python).

Instructions for performing various operations may also be implemented in computer languages such as array languages, aspect-oriented languages, assembly languages, authoring languages, command line interface languages, compiled languages, concurrent languages, curly-bracket languages, dataflow languages, data-structured languages, declarative languages, esoteric languages, extension languages, fourth-generation languages, functional languages, interactive mode languages, interpreted languages, iterative languages, list-based languages, little languages, logic-based languages, machine languages, macro languages, metaprogramming languages, multiparadigm languages, numerical analysis, non-English-based languages, object-oriented class-based languages, object-oriented prototype-based languages, off-side rule languages, procedural languages, reflective languages, rule-based languages, scripting languages, stack-based languages, synchronous languages, syntax handling languages, visual languages, wirth languages, embeddable languages, and xml-based languages. Various memory units may also be used for storing temporary variable or other intermediate information during execution of instructions to be executed by processing unit(s) 612.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms "display" or "displaying" means displaying on an electronic or computer device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Embodiments disclosed herein include:

A. A method comprising receiving, by one or more processors, one or more input variables associated with one or more characteristics of a well during a first time period, calculating a first pressure relief valve (PRV) set point based at least partially on a model of the well utilizing the one or more input variables received during the first time period, determining whether the first PRV set point is valid based at least partially on a predetermined expected range of PRV set points for the well; and transmitting the first PRV set point to a PRV controller when the first PRV set point is determined to be valid.

B. A system comprising one or more processors, and memory including instructions that, when executed by the one or more processors, cause the one or more processors to receive one or more input variables associated with one or more characteristics of a well, calculate one or more pressure relief valve (PRV) set points based at least partially on a model of the well utilizing the one or more received input variables, determine whether the one or more PRV set points are valid based at least partially on a predetermined expected range of PRV set points for the well, and transmit the one or more PRV set points to a PRV controller when the one or more PRV set points are determined to be valid.

C. A well system comprising a blowout preventer (BOP) stack, a choke manifold operatively coupled to the BOP stack, a pressure relief valve (PRV) operatively coupled to the choke manifold, a controller operatively coupled to the PRV, and a computer system that includes one or more processors and memory including instructions that, when executed by the one or more processors, cause the one or more processors to receive one or more input variables associated with one or more characteristics of the well system, calculate one or more PRV set points based at least partially on a model of the well system utilizing the one or more received input variables, determine whether the one or more PRV set points are valid based at least partially on a predetermined expected range of PRV set points for the well system, and transmit the one or more PRV set points to the controller for controlling the PRV when the one or more PRV set points are determined to be valid.

Each of embodiments A, B, and C may have one or more of the following additional elements in any combination: Element 1: wherein the one or more input variables associated with one or more characteristics of the well comprise at least one of a rotary speed of a drill string or a drilling fluid flow rate. Element 2: wherein the one or more input variables associated with one or more characteristics of the well comprise a pressure of a backpressure pump. Element 3: wherein calculating the first PRV set point comprises adding an offset value to a computed value for the first PRV set point. Element 4: wherein calculating the first PRV set point comprises determining a bottom hole pressure of the well. Element 5: wherein determining the bottom hole pressure comprises determining at least one of a hydrostatic pressure, a frictional pressure, and a backpressure. Element 6: further comprising determining, when the first PRV set point is determined to be invalid, whether an input variable value of one of the one or more input variables is out of variance with a predetermined range of acceptable input variable values corresponding to the one of the one or more input variables, recalculating, when the input variable value corresponding to the one of the one or more input variables is determined to be out of variance, the first PRV set point being based at least partially on the model of the well utilizing a default value for the one of the one or more input variables, and transmitting a recalculated first PRV set point to a PRV controller when the recalculated first PRV set point is determined to be valid. Element 7: further comprising receiving, by the one or more processors, one or more input variables associated with one or more characteristics of the well during a second time period different than the first time period, calculating a second PRV set point based at least partially on the model of the well utilizing the one or more input variables received during the second time period, determining whether the second PRV set point is valid based at least partially on the predetermined expected range of PRV set points for the well, and transmitting the second PRV set point to the PRV controller when the second PRV set point is determined to be valid. Element 8: further comprising determining a PRV set point trend line based at least partially on the first PRV set point and the second PRV set point, and calculating one or more additional PRV set points based at least partially on the PRV set point trend line.

Element 9: wherein the one or more input variables associated with one or more characteristics of the well comprise at least one of a drill bit depth within the well or a hole depth of the well. Element 10: wherein the one or more input variables associated with one or more characteristics of the well comprise at least one of a bottom hole assembly (BHA) temperature, a BHA pressure, and a BHA equivalent circulating density. Element 11: wherein the instructions that, when executed by the one or processors, cause the one or more processors to calculate the one or more PRV set points, further cause the one or more processors to calculate the one or more PRV set points at a first interval of time. Element 12: wherein the instructions that, when executed by the one or more processors, further cause the one or more processors to detect a threshold change in one of the one or more input variables, and determine whether a mode of drilling operation has changed based at least partially on the threshold change corresponding to the one of the one or more input variables. Element 13: wherein the instructions that, when executed by the one or processors, cause the one or more processors to calculate the one or more PRV set points at the first interval of time, further cause the one or more processors to change from calculating the one or more PRV set points at the first interval of time to calculating the one or more PRV set points at a second interval of time different from the first interval of time, when the one or more processors determine that the mode of drilling operation has changed.

Element 14: further comprising a backpressure pump operatively coupled to the choke manifold, wherein the one or more input variables comprise a flow rate of the backpressure pump. Element 15: further comprising one or more drilling fluid pumps, and a drilling fluid pump diverter operatively coupled to the one or more drilling pumps and to the choke manifold, the drilling pump diverter being configured to divert drilling fluid flow of the one or more drilling pumps to the choke manifold, wherein the one or more input variables comprise a flow rate of the one or more drilling fluid pumps. Element 16: further comprising one or more drilling fluid pumps, a drill string operatively coupled to the BOP stack, and a continuous circulation device operatively coupled to the drill string, the continuous circulation device being configured to provide continuous drilling fluid circulation by allowing the one or more drilling fluid pumps to stay active when a new drill pipe segment is being connected to the drill string. Element 17: further comprising a tubular assembly operatively coupled to the BOP stack, and one or more cement pumps operatively coupled to the tubular assembly, the one or more cement pumps being configured to inject a cement composition to the tubular assembly.

By way of non-limiting example, exemplary combinations applicable to A, B, and C include: Element 4 with Element 5; Element 11 with Element 12; and Element 12 with Element 13.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method comprising:

receiving, over time during operations of a well, multiple instances of input variables associated with characteristics of the well;

for each instance of the input variables, inputting the instance of the input variables to a hydraulic model of the well to generate output from the hydraulic model;

calculating a pressure relief valve (PRV) set point based at least partially on the output from the hydraulic model of the well;

determining whether the PRV set point is valid based at least partially on a predetermined expected range of PRV set points for the well; and transmitting the PRV set point to a PRV controller when the PRV set point is determined to be valid.

2. The method of claim 1, wherein the input variables associated with the characteristics of the well comprise at least one of a rotary speed of a drill string or a drilling fluid flow rate.

3. The method of claim 1, wherein the input variables associated with the characteristics of the well comprise a backpressure applied at a backpressure pump.

4. The method of claim 1, wherein calculating a first PRV set point comprises calculating a maximum allowable pressure of the well system and a pore-pressure-fracture-gradient window and adding an offset value to a minimum pressure of the pore-pressure-fracture-gradient window as long as the offset value plus the minimum pressure of the pore-pressure-fracture-gradient window is less than the lower of a maximum allowable pressure or a maximum pressure of the pore-pressure-fracture-gradient window.

5. The method of claim 1, wherein calculating a first PRV set point comprises calculating an instantaneous bottom hole pressure of the well.

6. The method of claim 5, wherein calculating the instantaneous bottom hole pressure comprises measuring at least one of a hydrostatic pressure, a frictional pressure, and a backpressure.

7. The method of claim 1, further comprising:

determining, when the PRV set point is determined to be invalid, whether an input variable value of the instance of the input variables is out of a predetermined range of acceptable input variable values corresponding to the input variable;

inputting, when the input variable value corresponding to the input variable is determined to be out of range, a default value for the input variable that is out of range to the hydraulic model of the well to generate output from the hydraulic model;

recalculating the PRV set point based at least partially on the output from the hydraulic model of the well; and transmitting a recalculated PRV set point to a PRV controller when the recalculated PRV set point is determined to be valid.

8. The method of claim 1, wherein each instance of the input variables corresponds to a different data acquisition time period based at least in part on a mode of drilling.

9. The method of claim 8, further comprising:

determining a PRV set point trend based at least partially on a first instance of the PRV set point and a second instance of the PRV set point; and extrapolating one or more additional PRV set points based at least partially on the PRV set point trend.

10. A system comprising:

one or more processors; and memory including instructions that, when executed by the one or more processors, cause the one or more processors to:

obtain, over time during operations of a well, multiple instances of input variables associated with characteristics of the well;

for each instance of the input variables, input the instance of the input variables to a hydraulic model of the well to generate output from the hydraulic model;

calculate one or more pressure relief valve (PRV) set points based at least partially on the output from the hydraulic model of the well;

determine whether the one or more PRV set points are valid based at least partially on a predetermined expected range of PRV set points for the well; and transmit the one or more PRV set points to a PRV controller when the one or more PRV set points are determined to be valid.

11. The system of claim 10, wherein the input variables associated with the characteristics of the well comprise at least one of a drill bit depth within the well or a hole depth of the well.

12. The system of claim 10, wherein the input variables associated with the characteristics of the well comprise at least one of a bottom hole assembly (BHA) temperature, a BHA pressure, and a BHA equivalent circulating density.

13. The system of claim 10, wherein each instance of the input variables corresponds to a different data acquisition time period.

14. The system of claim 13, wherein the instructions that, when executed by the one or more processors, further cause the one or more processors to:

detect a threshold change in one of the multiple input variables; and determine whether a mode of drilling operation has changed based at least partially on the threshold change corresponding to the one of the one or more input variables.

15. The system of claim 14, wherein each instance of the input variables corresponds to a different data acquisition time period based, at least in part on, the mode of drilling.

16. A well system comprising:

a blowout preventer (BOP) stack;

a choke manifold operatively coupled to the BOP stack;

one or more pressure relief valves (PRV) operatively coupled to the choke manifold;

a controller operatively coupled to the PRV; and a computer system that includes one or more processors and memory including instructions that, when executed by the one or more processors, cause the one or more processors to:

receive, over time during operations of a well, multiple instances of input variables associated with characteristics of the well system;

for each instance of the input variables, input the instance of the input variables to a hydraulic model of the well to generate output from the hydraulic model;

calculate one or more PRV set points based at least partially on the output from the hydraulic model of the well system;

determine whether the one or more PRV set points are valid based at least partially on a predetermined expected range of PRV set points for the well system; and transmit the one or more PRV set points to the controller for controlling the PRV when the one or more PRV set points are determined to be valid.

17. The well system of claim 16, further comprising:

a backpressure pump operatively coupled to the choke manifold, wherein the input variables comprise a flow rate of the backpressure pump.

18. The well system of claim 16, further comprising:

one or more drilling fluid pumps; and a drilling fluid pump diverter operatively coupled to the one or more drilling fluid pumps and to the choke manifold, the drilling fluid pump diverter being configured to divert drilling fluid flow from the one or more drilling pumps to the choke manifold, wherein the input variables comprise a flow rate of the one or more drilling fluid pumps.

19. The well system of claim 16, further comprising:

one or more drilling fluid pumps;

a drill string operatively coupled to the BOP stack; and a continuous circulation device operatively coupled to the drill string, the continuous circulation device being configured to provide continuous drilling fluid circulation by the one or more drilling fluid pumps when a new drill pipe segment is being connected to the drill string.

20. The well system of claim 16, further comprising:

one or more cement pumps fluidically coupled to BOP stack, the one or more cement pumps being configured to inject a cement composition into the well through the BOP stack.

* * * * *